US010689869B1

(12) United States Patent
Brown

(10) Patent No.: US 10,689,869 B1
(45) Date of Patent: Jun. 23, 2020

(54) SYSTEM METHOD AND DEVICE FOR STRUCTURAL REPAIR

(71) Applicant: Robert K. Brown, Phoenix, AZ (US)

(72) Inventor: Robert K. Brown, Phoenix, AZ (US)

( * ) Notice: Subject to any disclaimer, the term of this patent is extended or adjusted under 35 U.S.C. 154(b) by 0 days.

(21) Appl. No.: 16/414,693

(22) Filed: May 16, 2019

Related U.S. Application Data

(60) Provisional application No. 62/672,468, filed on May 16, 2018, provisional application No. 62/672,518, filed on May 16, 2018.

(51) Int. Cl.

| | |
|---|---|
| ***E04G 23/02*** | (2006.01) |
| ***E04C 3/294*** | (2006.01) |
| ***E02D 5/52*** | (2006.01) |
| ***E04B 1/92*** | (2006.01) |
| ***E02D 5/54*** | (2006.01) |
| ***E02D 5/80*** | (2006.01) |
| ***E02D 5/28*** | (2006.01) |

(52) U.S. Cl.
CPC ..... *E04G 23/0229* (2013.01); *E02D 5/28* (2013.01); *E02D 5/526* (2013.01); *E02D 5/54* (2013.01); *E02D 5/80* (2013.01); *E04B 1/92* (2013.01); *E04C 3/294* (2013.01)

(58) Field of Classification Search
CPC ..... E04G 23/0229; E04G 23/0203; E02D 35/005; E02D 37/00; E02D 2001/3588; E04B 1/3522
USPC ..... 52/514.5; 428/63
See application file for complete search history.

(56) References Cited

U.S. PATENT DOCUMENTS

| | | | | |
|---|---|---|---|---|
| 2,280,220 | A * | 4/1942 | Crosby | E04B 1/36 52/126.6 |
| 5,246,311 | A * | 9/1993 | West | E02D 35/00 405/229 |
| 5,399,055 | A * | 3/1995 | Dutton, Jr. | E02D 35/00 405/230 |
| 6,052,964 | A * | 4/2000 | Ferm | E01C 11/14 52/742.14 |
| 10,138,626 | B1 * | 11/2018 | Cates | E04G 23/065 |
| 2009/0013625 | A1 * | 1/2009 | Tourneur | E02D 27/08 52/223.13 |
| 2015/0354238 | A1 * | 12/2015 | Abbasi | E04G 23/02 52/514.5 |
| 2018/0087273 | A1 * | 3/2018 | Grussenmeyer | E04C 3/34 |
| 2019/0119876 | A1 * | 4/2019 | Grussenmeyer | E04H 12/2284 |
| 2019/0316314 | A1 * | 10/2019 | Barton | E02D 5/30 |

* cited by examiner

*Primary Examiner* — Gisele D Ford
(74) *Attorney, Agent, or Firm* — Booth Udall Fuller, PLC

(57) ABSTRACT

A method of reinforcing a structure comprising a wall built on a reinforced concrete stem wall may include removing concrete from the reinforced concrete stem wall at an exterior of the structure to expose the reinforcing material within the stem wall and create a space within the stem wall. A degraded portion of the of the reinforcing material may be removed. A hold-down may be partially disposed within the wall inserting, from below the wall, such that an upper portion of the hold-down is disposed within the wall and a lower portion of the hold-down extends into the space within the stem wall. A horizontal composite bar may be coupled to the exposed reinforcing material and to the lower portion of the hold-down. A cementitious material may be disposed in the space within the stem wall, around the lower portion of the hold-down, and around the horizontal composite bar.

20 Claims, 7 Drawing Sheets

SYSTEM METHOD AND DEVICE FOR STRUCTURAL REPAIR

RELATED APPLICATIONS

This application claims the benefit of U.S. provisional patent application 62/672,468, filed May 16, 2018 titled "System, Method and Device for Structural Repair," and U.S. provisional patent application 62/672,518, filed May 16, 2018 titled "System, Method and Device for Structural Repair," the entirety of the disclosures of which are incorporated herein by this reference.

TECHNICAL FIELD

This disclosure relates to a system, method, and device for structural repair of structures, such as structures including reinforced concrete.

BACKGROUND

Many structures, including buildings such as homes, offices, retail space, and manufacturing space, are built with at least a portion of the building in direct contact with soils. Soils provide a base or platform on which the building can rest, and that can serve to support the building. Soils can exhibit fluid characteristics, and as a consequence, a solid base such as a foundation, is generally provided as part of building construction. While a foundation may provide a more stable substructure than bare soil, the fluid properties of soils can compromise a foundation, or cause the foundation to weaken, degrade, or fail. Many different types of soils are encountered in different geographic locations and in different building situations, which can require adaptations so that the building foundation interacts with the soil in such a way as to provide adequate support and reduces, minimizes, or maintains relative movement of the building and the soil within acceptable tolerances.

FIG. 1A shows a cross-sectional view of a portion of a structure or house 10 that is built using slab on grade construction. Structure 10 can include footings 12 and stem walls 14 that together form foundation 16. Footings 12 can be made or concrete reinforced with steel, such as rebar. Stem walls 14 can similarly be reinforced concrete, or alternatively can be masonry or block. Together, foundation 16 can support a superstructure or a balance of structure 10 including walls 18 and a roof 20. Both walls 18 and roof 20 can be constructed of lumber. Alternatively, walls 16 can be constructed or masonry, block, steel, other metal, or any other suitable material.

Foundation 16 can be disposed in, and supported by, native soil 24. Soil 24 can also provide support for floor slab 26. Slab on grade construction includes a concrete floor slab 26 that can be poured, formed, or built within a perimeter formed by the stem wall 14. Floor slab 26 can be in contact, and often direct contact, with leveled or graded soil. The graded soil can be formed as a prepared pad of soil that has been compacted for stability and built to a particular elevation or grade to account for drainage away from the building and other issues. Advantageously, an intermediate layer of engineered soil or an aggregate base course (ABC) 28 including rock, sand, and dirt can be deposited, graded, wet, and compacted over native soil 24 before placing and finishing concrete floor slab 26 to reduce soil movement and attendant cracking of floor slab 26.

In other instances, foundation 16 may be disposed in, and supported by, native soil 24 while the floor is elevated above, and not in direct contact with, the soil 24. In such instances, an airgap or crawl space may be disposed or formed between the floor and the soil 24.

FIG. 1B shows a perspective view of a cross-section of a portion of the structure or house 10 that is built with the wall 18 coupled to, and resting on, the foundation 16. As shown in FIG. 1B the wall can comprise a horizontal base plate, sole plate, bottom plate, or mudsill 30. The base plate 30 may be made of wood, or metal, such as aluminum, steel (galvanized, stainless, or other), as well as any composite material or other suitable material. On top of the base plate 30, a number of vertical studs 32 are attached or coupled to the base plate 30 and the foundation 16. The studs 32 may be made of wood, or metal, such as aluminum, steel (galvanized, stainless, or other), as well as any composite material or other suitable material, that may be the same or different than base plate 30. The base plate 30 and the studs 32 may be attached or coupled to the foundation 16, and more particularly the stem wall 14, with multiple anchors, strap anchors, metal straps, or anchor bolts 34. The anchors 34 comprise a first portion 34*a* extending above and out of the stem wall 14 and a second or lower portion 34*b* encased in the stem wall 14 or coupled to the foundation 16. The first portion 34*a* of anchor 34 is coupled to the base plate 30, studs 32, or both, by mechanical fasteners 36 which comprise nails, screws, spikes, staples, or washers and bolts. The anchors 34 may comprise strap anchors 35*a*, as well as anchor bolts or j-bolts 35*b*, as shown in FIG. 1B. The j-bolts may couple the wall 18 to the stem wall 14 by including a lower portion of the j-bolt 35*b* disposed within cured concrete of the stem wall 14, and the upper portion of the j-bolt 35*b* being coupled to the base plat 30 with washer 35*c* and nut 35. A foam gasket 38 or other deformable material may be disposed between the base plate 30 and the stem wall 14 to close any gaps or spaces between the base plate 30 and the stem wall 14 to create a seal.

SUMMARY

A need exists for a system and method for structural repairs.

Accordingly, in an aspect, a method of structural repair can include reinforcing a structure including a wall built on a reinforced concrete stem wall may include removing concrete from the reinforced concrete stem wall at an exterior of the structure to expose the reinforcing material within the stem wall and create a space within the stem wall. A degraded portion of the of the reinforcing material may be removed. A non-ferrous jack including a base, a height adjustment member, and an upper pad opposite the base may be provided and inserted into the space with the jack base resting on an inner portion of the stem wall and the upper pad supporting the wall. A hold-down may be inserted or partially disposed within the wall, from below the wall, such that an upper portion of the hold-down is disposed within the wall and a lower portion of the hold-down extends into the space within the stem wall. A horizontal composite bar may be coupled to the exposed reinforcing material and to the lower portion of the hold-down. A cementitious material may be disposed in the space within the stem wall, around the jack, around the lower portion of the hold-down, and around the horizontal composite bar to form a repaired stem wall.

The method of structural repair can further include adjusting the height of the jack to elevate the upper pad to a height at which the upper pad contacts a base plate of the wall. The wall may includes a base plate and a stud coupled to the base plate, and the upper portion of the hold-down may be disposed partially within the base plate and partially within the stud. The hold-down may be inserted into the wall to resist a 2.67 kilonewton (kN) pull test. The space within the stem wall may be filled with cementitious material with the jack disposed within the space in the stem wall so that the jack is enveloped with the cementitious material and is incorporated within the repaired stem wall. As used herein, enveloped can mean providing 100 percent coverage or substantial coverage that is about 100 percent, but less than 100 percent or total coverage. The hold-down may further include a polypropylene loop configured to support a composite reinforcement bar. The horizontal composite material may be coupled by drilling and dowelling into the stem wall at 1.5 meter (m) intervals and coupling the horizontal composite bar to the dowels.

In another aspect, a method of reinforcing a structure including a wall built on a reinforced concrete stem wall may include removing concrete from the reinforced concrete stem wall at an exterior of the structure to expose the reinforcing material within the stem wall and create a space within the stem wall. A degraded portion of the reinforcing material may be removed. A hold-down may be inserted partially into the wall with an upper portion of the hold-down disposed within the wall and a lower portion of the hold-down extending into the space within the stem wall. A horizontal composite bar may be coupled to the exposed reinforcing material and to the lower portion of the hold-down. A cementitious material may be disposed in the space within the stem wall, around the lower portion of the hold-down, and around the horizontal composite bar to form a repaired stem wall.

The method of structural repair can further include providing a non-ferrous jack including a base, a height adjustment member, and an upper pad opposite the base. A jack may be inserted into the space within the stem wall, the jack base resting within the stem wall and the upper pad supporting the wall. The height of the jack may be adjusted to elevate the upper pad to a height at which the upper pad contacts a base plate of the wall. The space within the stem wall may be filled with cementitious material with the jack within the space in the stem wall so that the jack is enveloped with the cementitious material and is incorporated within the repaired stem wall. The wall may include a base plate and a stud coupled to the base plate, and the upper portion of the hold-down may be disposed partially within the base plate and partially within the stud. The hold-down may be inserted into the wall to resist a 2.67 kN pull test after the cementitious material is cured or has reached about 80% of full strength or about 90% of full strength. The hold-down may further include a polypropylene loop configured to support a composite reinforcement bar. The horizontal composite material may be coupled by drilling and dowelling into the stem wall at 1.5 m intervals and coupling the horizontal composite bar to the dowels. A surface of the space within the stem wall may be cleaned and the surface of the space within the stem wall parged with a parge coat and acrylic admixture.

In still another aspect, a method of reinforcing a structure including a wall built on a reinforced concrete stem wall may include exposing degraded reinforcing material within the stem wall from an exterior of the structure. A hold-down may be partially inserted into the wall with an upper portion of the hold-down disposed within the wall and a lower portion of the hold-down extending into a space within the stem wall. A horizontal composite bar may be coupled to the lower portion of the hold-down. Cementitious material may be disposed around the lower portion of the hold-down and around the horizontal composite bar to form a repaired stem wall.

The method of structural repair can further include providing a non-ferrous jack including a base, a height adjustment member, and an upper pad opposite the base. A jack may be inserted into a space within the stem wall and with the upper pad supporting the wall. The height of the jack may be adjusted to elevate the upper pad to a height at which the upper pad contacts a base plate of the wall. The space within the stem wall may be filled with cementitious material with the jack within the space within the stem wall so that the jack is enveloped with the cementitious material and is incorporated within the repaired stem wall. The wall may include a base plate and a stud coupled to the base plate. The upper portion of the hold-down may be disposed partially within the base plate and partially within the stud. The hold-down may further include a polypropylene loop configured to support a composite reinforcement bar. The horizontal composite material may be coupled by drilling and dowelling into the stem wall at 1.5 m intervals and coupling the horizontal composite bar to the dowels. A surface of the space within the stem wall may be cleaned and the surface of the space within the stem wall may be parged with a parge coat and acrylic admixture.

DETAILED DESCRIPTION

Figure 1A:
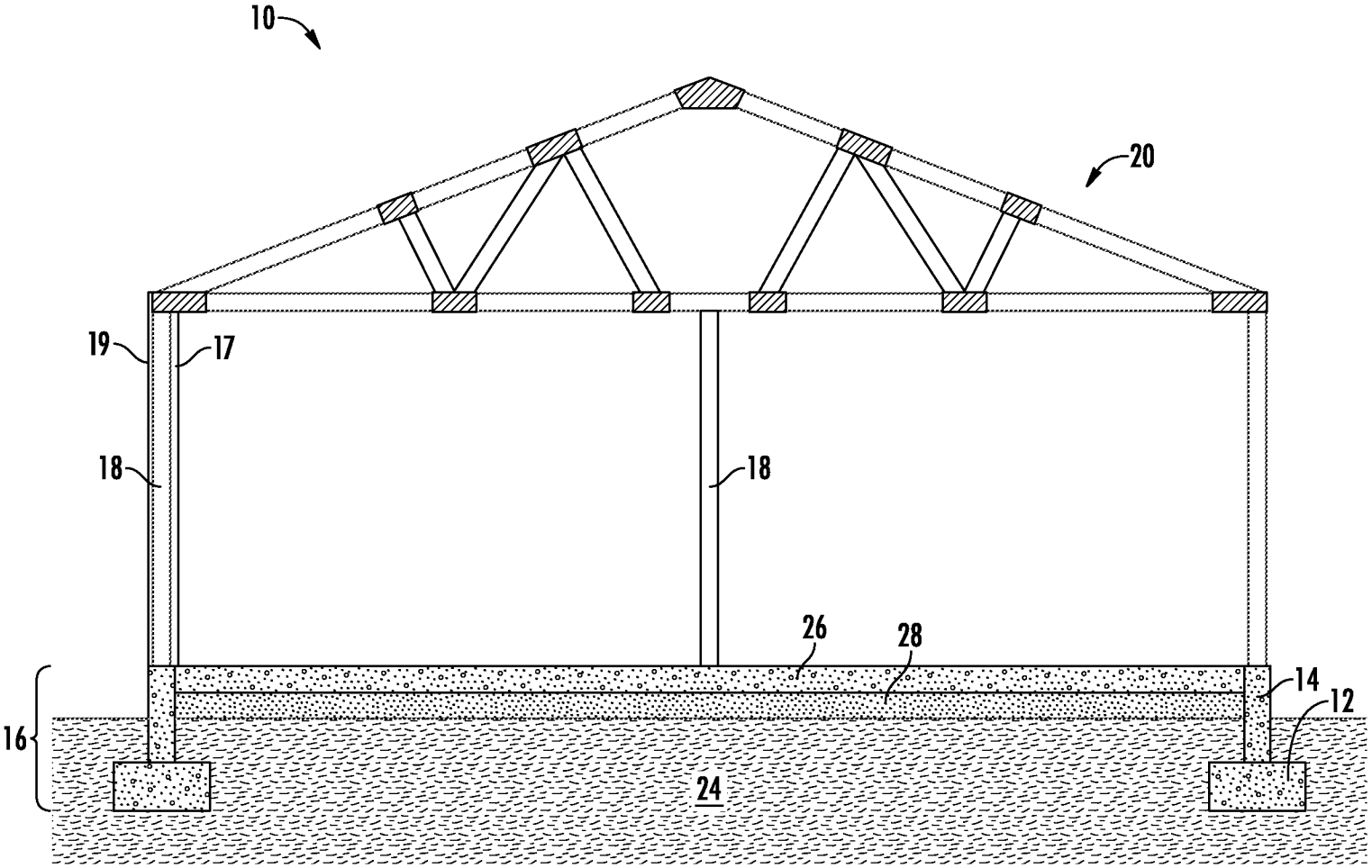
FIG. 1A (PRIOR ART)
FIGS. 1A and 1B show various views of structures as known in the prior art.
Figure 1B:
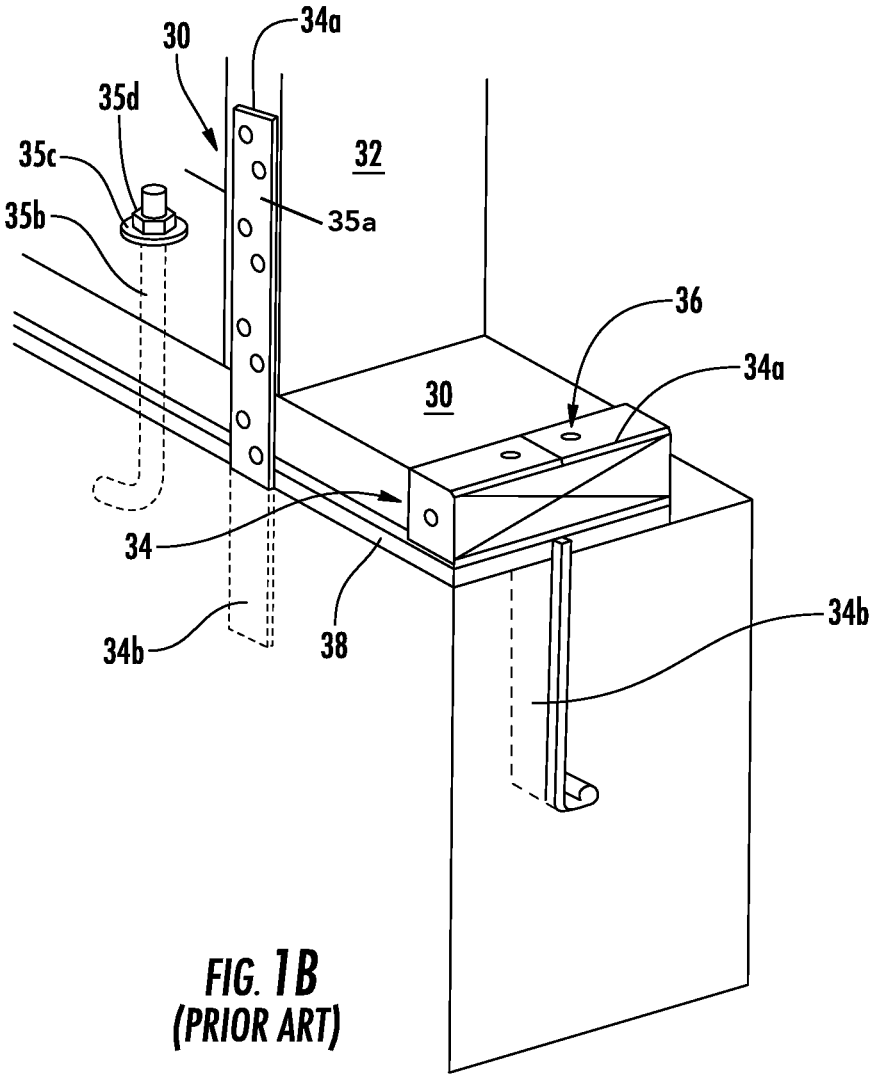
FIG. 1B (PRIOR ART)

This disclosure, its aspects and implementations, are not limited to the specific material types, or other system component examples, or methods disclosed herein. Many additional components, construction and assembly procedures known in the art are contemplated for use with particular implementations from this disclosure. Accordingly, for example, although particular implementations are disclosed, such implementations and implementing components may include any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

Figure 2A:
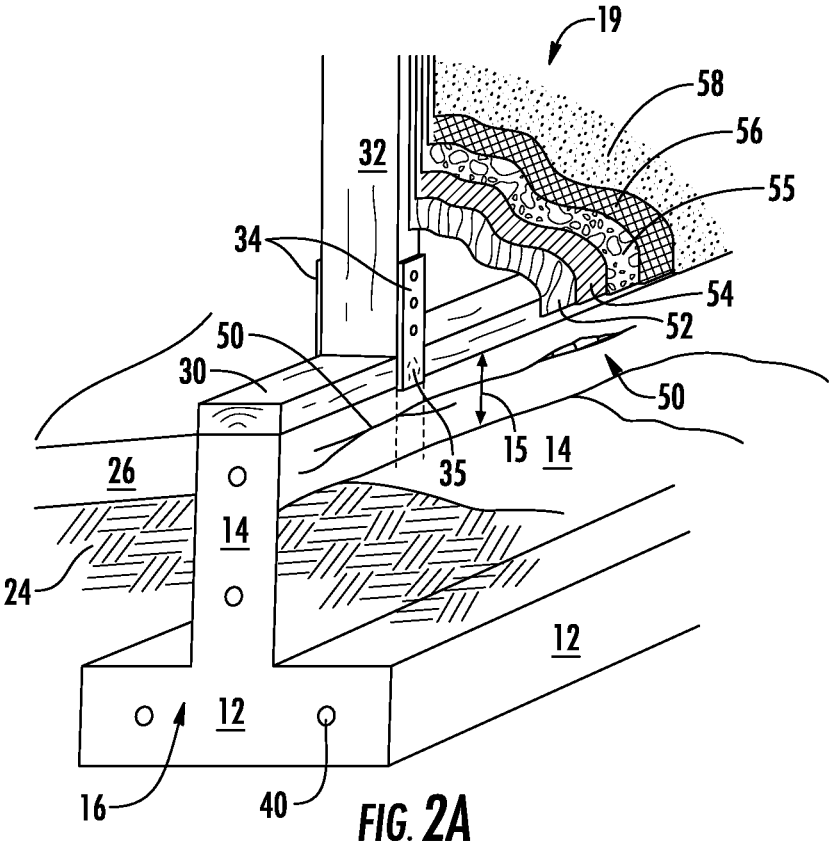
FIGS. 2A-2B show a perspective view of framing on top of a damaged reinforced concrete stem wall.
Figure 2B:
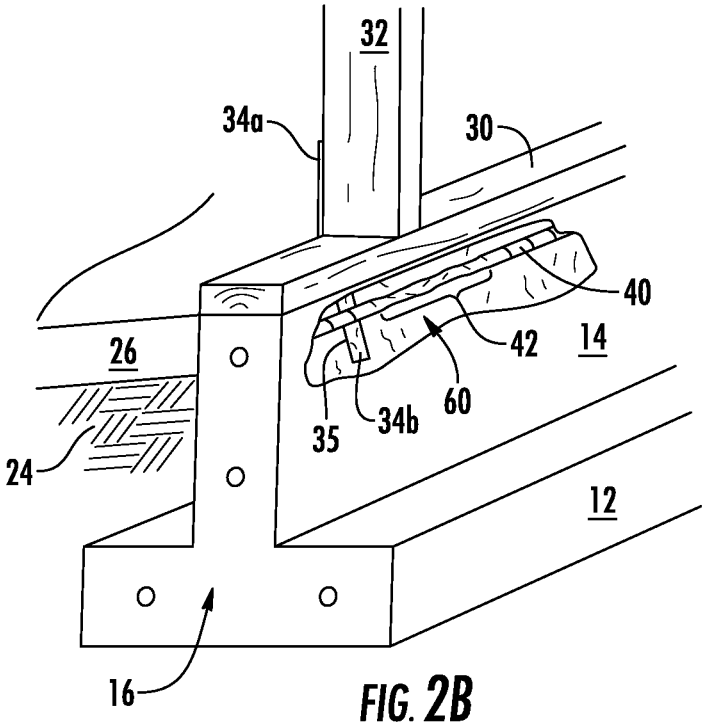

FIGS. 2A-2B show perspective views of a wall 18 resting on, and supported by, a damaged reinforced concrete stem wall 14 supported by footing 12. As shown in FIG. 2A, reinforced concrete foundations 16 including concrete or a cementitious material reinforced with iron, steel, rebar, metal, or other high-tensile strength material or reinforcement 40, which for convenience and not by limitation will hereinafter be referred to as "rebar 40." As used herein "cementitious" means any material including cements, such as concrete, grout, mortar, thin set, patching material, or a functional equivalent that uses other adhesives or resins without cement to provide a material that hardens and bonds to a cementitious material including cement. Reinforced concrete foundations, including stem walls 14 will crack or weather when exposed to moisture or water over time. Water or moisture can deteriorate the concrete stem wall 14, can access or contact the rebar or metal reinforcement 40 (referred to herein for convenience as rebar) within the stem wall 14, and the rebar 40 can begin to form ferrous oxide, or rust, which can reduce and compromise structural integrity of the rebar 40 and of the foundation 16 as a whole.

A number or reasons exists as to why many stem wall repairs fail prematurely, or in a short period of time. Concrete begins with a high alkaline level (normally with a pH of about 13). Over time the concrete becomes more acidic due to carbonization of CO2 and High sulfate levels. Concrete also includes millions of pores that contain moisture. Over time moisture is absorbed by the concrete of the footing 12 and of the stem wall 14 with the moisture wicking up through the concrete. Some of the moisture exits from the face of the stem wall 14, such as at the exposed strip 15 of the stem wall 14 where the exposed strip is below the wall 18 and not covered by the soil 24. Moisture that contacts and passes through the foundation 16 can come from a variety of sources, including storm run-off from the roof, storm water in the yard, plumbing leaks, underground moisture/vapor, irrigation, and from neighbors or adjoining properties. Taken together, the high pH of the concrete, the moisture in the concrete pores, and the iron or rebar 40 develops a micro electrochemical current. The micro electrochemical current deposits chloride ions ($Cl^-$) on the iron or rebar 40 that catalyzes rapid iron oxidation ($Fe_2O$) or rusting. As iron oxidizes the iron or rebar 40 increases in volume and produces tensile pressure on the concrete within the stem wall 14, which leads to increased cracking, breaking, and spalling 50, which in turn increases the presence of water and further oxidation of rebar 40. An example of cracking 50 in the concrete of the stem wall 14 is shown in FIG. 2A.

Fixing degraded, rusted, or corroded sections 42 of rebar 40 is important for maintaining strength in the stem wall 14 and in the foundation 16. Non-reinforced concrete has a high compressive strength and a low tensile strength. Reinforcement of the concrete with a high tensile strength material like rebar 40 makes the concrete much stronger. However, when the rebar 40 is degraded, rusted, or corroded, the rebar 40 no longer performs as it was designed to perform in the engineering process, the foundation 16 no longer has the strength or ability to span over small voids to prevent settlement and is susceptible to cracking all the way through, which can lead to a complete failure in supporting the structure 10, including walls 18 and roof 20.

Improper repairs tend to cover-up rather than address the underlying issues of corroding rebar 40. Improper repairs can include filling in or covering cracking 50, without addressing the rusting rebar 40. By patching over rusted rebar, electric charge and chloride ion migration continue, paint and patching can bubble, crack, and fall away while and cracking continues and deterioration of the rebar 40 by rusting continues. All or most steel or rebar 40 embedded in concrete will oxidize over time, even when following the recommended repair protocols of the International Concrete Repair Association. Recommended repair protocols for steel embedded in concrete can be costly and time intensive to stop, mitigate, or repair the damage. Defective or cracking concrete can be removed and replaced. Similarly, defective or rusted rebar, can be replaced. In some instances, when rust or corrosion is not too extreme, the rebar may be treated and not removed by i) sandblasting to white metal, ii) coating with blocking epoxy, and iii) patch with anodic modified cement. Rebar 40 can also be coated, such as with an epoxy coating. However, the epoxy coating is temporary, does not stop micro electrical current, and can be compromised during installation, leaving portion of the rebar 40 exposed and vulnerable. Waterproof coatings applied to stem walls to keep water out have the adverse effect of trapping moisture in the stem wall, were it contributes to the formation of chloride ions and oxidation of rebar 40.

Once chloride ion migration begins within a stem wall 14 or foundation 16, it is very difficult to stop. A number of possible remedies will not stop the oxidation of rebar 40 and of the anchors 40, will allow rust to remain present, and will allow micro electrochemical current to be present. These possible and ineffective remedies include: patching cracks 50, applying an epoxy injection or coating, replacing the corroded or rusted rebar 42 with standard rebar 40, replacing the corroded or rusted rebar 42 with epoxy coated rebar 40, and applying a waterproof coating to the stem wall.

Other methods that to stop or minimize the oxidation process include installing an electrical cathodic protection system that will revers current flow. Cathodic protection system are most often used in power plants and other highly corrosive environments, but are not cost effective for residential applications, generally costing in a range of about $20,000.00-$30,000.00. Unless otherwise specified, "about" as used herein means a percent difference of 0-5%, 1-10%, 1-20%, or 1-30%. Another way to stop rusting is to eliminate ferrous materials, such as replacing rebar 40 with a non-ferrous horizontal composite bar 110 or a non-ferrous dowel 112. In order to minimize oxidation, other options are available including: using passive current blocking technology, removing all rust by sand-blasting or other suitable technique, coating the ferrous rebar 40 with ion blocking epoxy, patching rebar 40 with ion blocking epoxy, patch the stem wall 14 with anodic neutralized cement patch. In repairing rebar 40, if the circumference of the rebar cannot be safely cleaned and protected, or has deteriorated more than 20%, then the rebar 40 should be replaced to ensure the rebar 40 has the required strength. In most cases where the stem was has cracked and exposed the rebar 40, more than 20% of the circumference of the rebar has deteriorated, and even after repair a return of is likely even with minimizing remediation efforts.

FIG. 2A also illustrates an additional problem of the anchors 40, such as strap anchors or metal tie straps 34*b* can become a corroded, degraded, rusted anchor 34 (and structurally defective) when used to tie walls 18 to the foundation 16 (such as when the metal strap anchors 34*b* are imbedded in the stem 14, footings 12, or both). When the strap anchors

34*b* are rusted away or otherwise defective anchors 35, additional demolitions and repair may be required. This is also true for anchor bolts or j-bolts 34*b*.

When the strap anchors 34*b* are installed they will, or will often, extend from the concrete of stem wall 14 up though the wall 18 along vertical studs 32 or the framing about 24". The strap anchors 34*b* can be disposed at an inner surface or part of the wall 18 oriented towards an interior of the structure 10, such as disposed between the interior of the structure 10 or between the interior wall 17 and the vertical studs 32. The interior wall 17 may be formed of gypsum board, drywall, or other suitable material. The strap anchors 34*b* can also be, and often are, disposed at an outer part of the wall 18, such as oriented away from the structure 10 and disposed between the exterior wall 19 and the vertical studs 32. Both positions of the strap anchor 34*b* being at the interior or exterior of studs 32 is shown in FIG. 2A. In some instances, strap anchors 34*b* will include a thickness of 1.6 millimeters (mm) (or 1/16 inch (in.)) and include an exposed portion of up to 3.8 centimeters (cm) (or 1.5 in.), which is an amount of exposure permitted by local building code, and may vary somewhat by jurisdiction.

The exterior wall 19 may be formed of a plurality of layers including, for example, siding or sheathing 52 disposed over the vertical studs 32. The siding 52 includes oriented strand board (OSB), plywood, or suitable material. A vapor barrier, tar paper, or weather wrap 54 may be disposed over the sheathing 52 to prevent moisture from entering the structure 10 through the wall 19, and may include any suitable material as known in the art. An insulation or foam layer 55 may be disposed over the vapor barrier 54 and sheathing 52. The insulation layer 55 may include expanded polystyrene (EPS) or any other suitable material as known in the art. A reinforcement layer 56 may be disposed over the insulation layer 55, the vapor barrier 54, and the sheathing 52. The reinforcement layer 56 may be lathe, metal reinforcement, woven wire, stucco netting, wire mesh or other suitable material that provides structural strength and a bonding surface for the subsequently formed stucco or finish layer 58. The stucco layer 58 may then be applied over the reinforcement layer 58. When the finish layer 58 is not stucco, but is instead some other siding like planks, shingles, stone or composite veneer, the reinforcement may not be present.

In any event, whatever the specific arrangement of the exterior wall 19, the exterior wall may include one or more layers of siding 52, vapor barrier 54, insulation 55, reinforcement 56, stucco 58, as well as other desirable layers or materials. The exterior wall 19 can cover or limit access to the strap anchors 34*b* that are coupled to the studs 32 of the wall 18, and make access to, and replacement of, the strap anchors 34*b* difficult. Furthermore, strap anchors 34*b* are thin and deteriorate easily. When encountered during field inspections or repairs, the strap anchors 34*b* are very often seriously degraded or almost completely gone due to rust and corrosion. FIG. 2A shows corroded portion 35 of the strap anchor 34 at the exterior of the structure 10 between the wall 18 and the stem wall 14, such as at the exposed strip 15 of the stem wall 15. Removing a damaged strap 34*b* and replacing it with a new strap 34*b* can be difficult, time-consuming, and expensive in that removing and patching or replacing of portions of the interior wall 17 or exterior wall 19 is required. Patching of the interior wall 17 or the exterior wall 19 can include replacement of stucco 58 at the exterior of the structure 10 and replacement of the drywall at the interior of the structure 10, which includes trying to match textures and colors. Additionally, with the replacement of a deteriorating or corroded strap anchors 34*b* with a new strap anchor 34*b* leaves the new strap anchor 34*b* susceptible to the same deterioration and corrosion experienced by the replaced strap 34*b*. Furthermore, the deterioration and corrosion experienced by the new strap anchors 34*b* may occur more quickly or be accelerated with respect to the replaced strap anchors 34*b* since the process of chloride ion migration could already be active and in progress. Accelerated deterioration of strap anchors 34*b* may also facilitated or exacerbated by portions of the strap anchors 34*b* being partially exposed and not being covered by concrete from the stem wall 14 or by the outer wall 19 or the inner wall 17, as shown, for example, in FIG. 2A.

FIG. 2B shows an example of removing a portion of the stem wall 14 to access and repair the rebar 40 and to remediate the failure or corrosion of one or more anchors 34, such as the rusting or corrosion of strap anchor 34*b*. The deteriorated concrete of stem wall 14 along crack 50 can be removed to a fractured rock strata, such as by chipping, scraping, prying, drilling or grinding, which can be accomplished by a jack hammer, roto hammer, hand tools, or any other desirable tool or system, whether chemical, mechanical, or both. Removal of the material can continue until the deteriorated rebar 40 is identified and exposed, and all ferrous oxide can be removed from the rebar 40 and the anchors 34. As noted above, when corrosion has reduced a circumference of the rebar 40 by about 20% or more, the damaged section of rebar 40 may be completely removed and subsequently replaces, as shown and discussed with respect to FIG. 4C. In some instances, soil 24 adjacent the exterior of the stem wall 14 may be removed or excavated to expose a greater portion of the stem wall 14, provide more space for workers enlarging crack 50 to form an opening 60 within the stem wall 14, in which to work, and to increase a height or area of the exposed strip 15 of the stem wall 14.

Figure 3A:
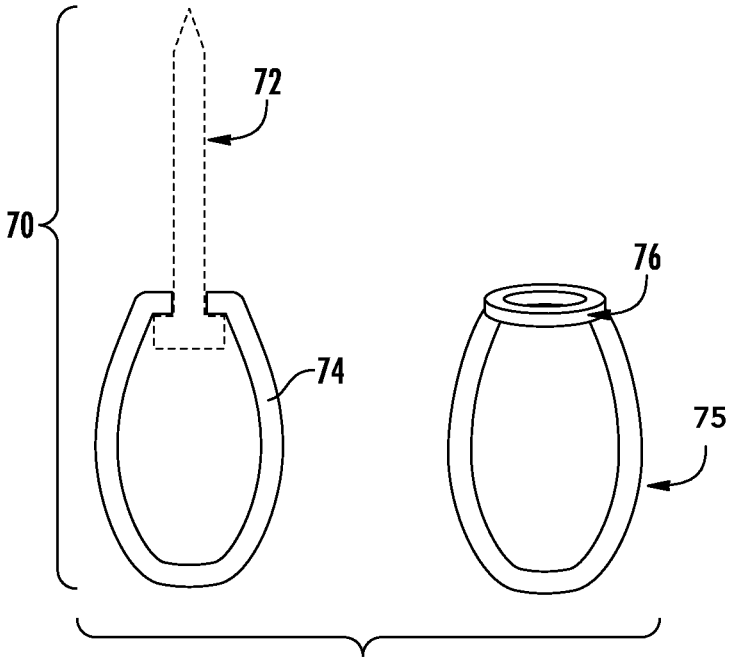
FIGS. 3A-3C show a jack and hold-downs used in repairing the damaged reinforced concrete stem wall.
Figure 3B:
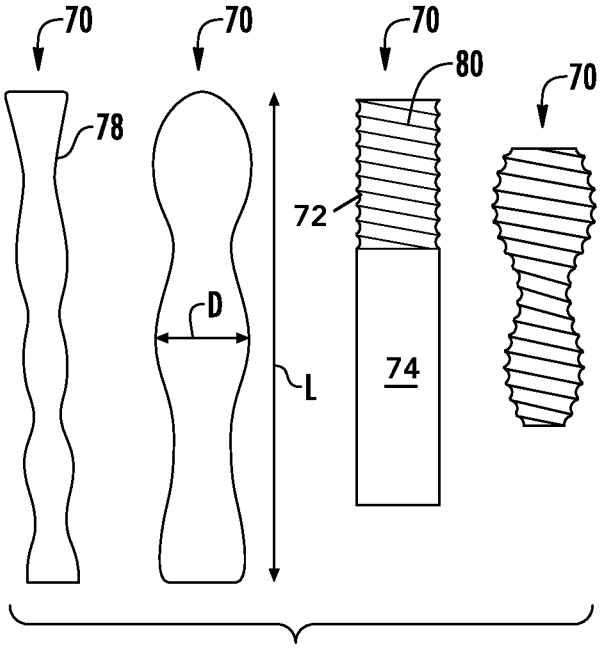

FIGS. 3A and 3B show various embodiments or aspects of fastening or attachment members, referred to hereinafter as hold-downs 70, that may be used in securing the wall 18 to the foundation 16 stem wall 14. Hold-downs 70 may be made of one or more nonferrous materials, including fiberglass, resin, metal, wood, stone, concrete, or other suitable material. FIG. 3A shows a hold-down 70 can include a top or upper portion 72 that may, and is configured to be, disposed within the wall 18 or a stud 32 of the wall 18. The hold-down 70 further includes a bottom or lower portion 74 that extends from the wall 18, such as from stud 32 or baseplate 30, into the foundation 16 or stem wall 14. More specifically, the lower portion 74 may extend into opening 60 in the stem wall 14 where a portion of the old stem wall 14 has been removed and the new foundation of stem wall or repair will occur.

Figure 4A:
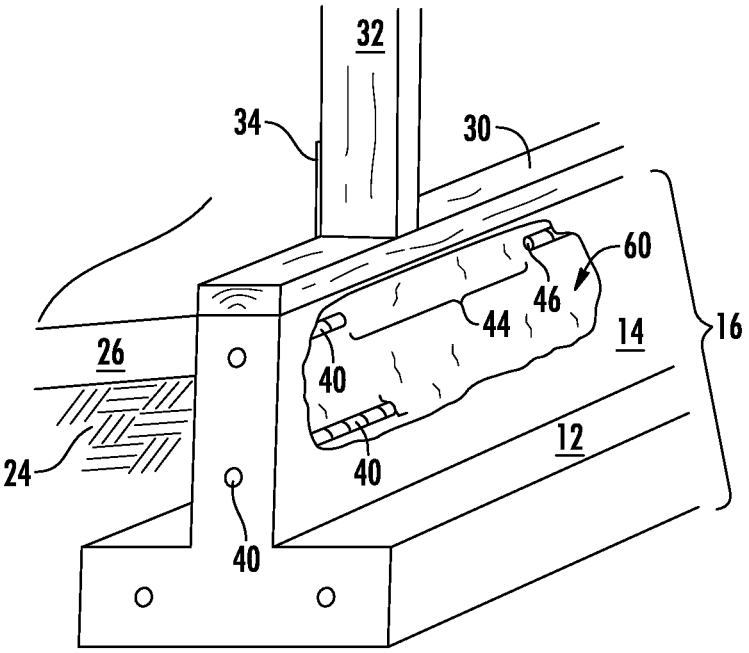
FIGS. 4A-4D show various aspects of a system and method for repairing the damaged reinforced concrete stem wall, including use of a jack and a hold-down.

As shown in FIG. 4A, in some embodiments the hold-down 70 include lower portions 74 formed as a loop assembly wherein the top or upper portion 72 of the hold-down 70 can be a lag bolt, or other existing structure such as a bolt or other fastener. The upper portion 72 can include a length of about 20 cm (or 8 in.) or in a range of about 0-25 cm (or 0-10 in.). The bottom or lower portion 74 of the hold-down 70 may be flexible or rigid, and may be shaped as a loop, hoop, or ring 75, or portion thereof, that is coupled to a rigid ring or attachment body 76, that can be coupled to the upper portion 72 when the upper portion 72 and the lower portion 74 are not integrally formed as a unitary member. In some instance the ring 76 may be integrally formed as a unitary member with the lower body 74 or in other cases as a separate unit coupled to the lower body 74.

FIG. 3B shows examples of other embodiments, shapes, and forms of the hold-downs 70. The hold-downs 70 may include side surfaces 78 that are smooth, textured, undulating, or threaded. When side surfaces 78 are threaded, the threading may be used in securing the upper end 72 of the hold-down within the wall 18. An entirety of the hold-down 70, or a portion less than an entirety of the hold-down 70, such as about half of the hold-down may be threaded. Lengths of some implementations of hold-downs 70 may be in a range of 10-46 cm (or 4-18 in.), 15-30 cm (or 6-12 in.), or about 20 cm (or 8 in.). In some instances, both the upper portion 72 and the lower portion 74 will include a length of about 20 cm (or 8 in.). Diameters of some implementations of hold-downs 70 may be in a range of 0.5-2.5 cm (or 0.25-1 in.). The installation of hold-down 70 is described in further detail with respect to FIGS. 4B and 4C.

Figure 3C:
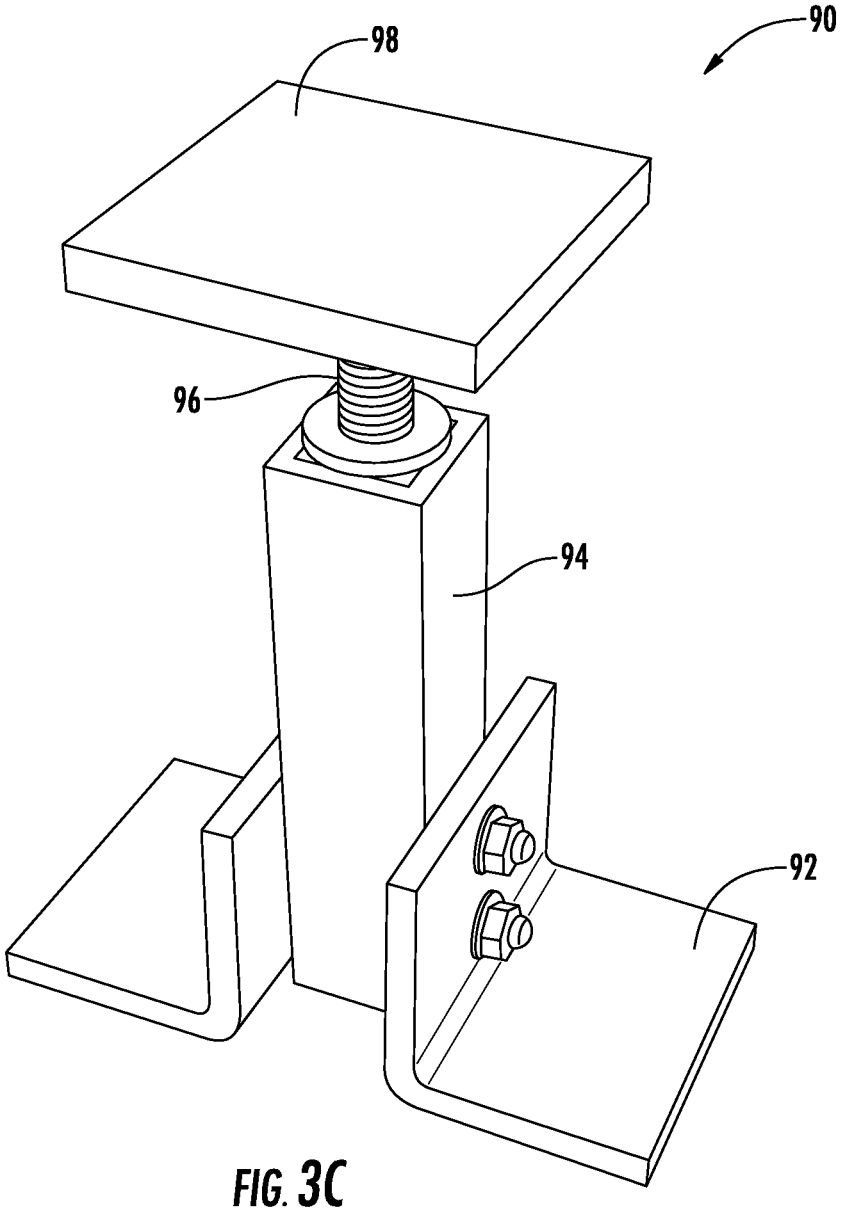

FIG. 3C, shows a nonferrous support, stand or jack 90, that can be made of one or more of fiberglass, resin, metal, wood, stone, concrete, or other suitable material. In some instances, the jack 90 is included of all or substantially all non-metallic components. As used herein, "substantially" means within a percent difference in a range of 0-5%, 1-10%, 1-20%, or 1-30% unless otherwise specified. Because jack 90 is made without any ferrous materials, the jack 90 will not rust, and prevents the spreading of rust to rebar 40 because the jack 90 is not a source for transmission of rust to the rebar 40, as anchors 34 can be.

FIG. 3C further shows that the jack 90 can include a body or vertical element 94 that provides offset between a base 92 and a pad, platform, upper pad, or upper platform 98. By way of example and not by way of limitation, the base 92 is shown as two attached angled pieces attached to the body 94 to provide support and prevent tipping of the jack 90. The upper platform 98 opposite the base 92 may also provide a surface to support objects (like a wall 18 or base plate 30). The upper platform 98 can be raised or lowered, such as by being twisted or rotated, to increase or decrease a distance between the base 92 and the upper platform 98, such as when the body 94 includes a threaded piece or any other suitable way of raising and lowering the upper platform 98 with respect to the base 92.

FIGS. 4A-4D show various aspects of the system and method for repairing the damaged reinforced concrete stem wall 14, including use of a jack and a hold-down. FIG. 4A shows that with or after the formation of opening 60, rusted components can be removed, such as degraded rebar 42 that has been removed to form removed section 44. Removal of a segment or portion of rebar 40 leaves exposed ends 46 of rebar 40 that remains within or adjacent the opening 60. The exposed ends 46 also define the ends of removed section 44. When too much material is removed from stem wall 14, the structure 10 is vulnerable to collapse or damage during repair, and as such shoring for temporary support can be supplied, such as in the form of jack 90 to reduce the risk of collapse or damage to the structure 10.

Figure 4B:
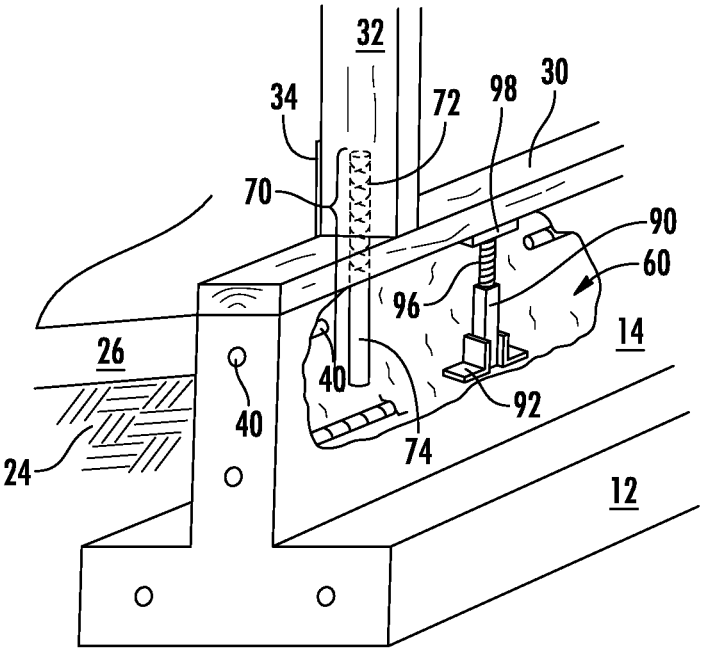

FIG. 4B, similar and continuing from FIG. 4A, shows the jacks 90 from FIG. 3C inserted into the opening 60 formed in the stem wall 14 shown in FIG. 4A. The jacks 90 support the wall 18, and may allow large and continuous sections of the stem wall 14, or multiple sections of the stem wall 14, to be worked on at a same time, without requiring additional reinforcing or shoring, and without compromising the structural integrity of the wall 18 or of the structure 10 during repairs. In instances where significant amounts of the stem wall 14 are removed and there is an absence support, shoring, or reinforcement, the stem wall 14 may be insufficient to support the wall 18, and lead to a failure or collapse. To prevent such collapse or risk of collapse, jacks 90 may be advantageously employed.

Additionally, because the jacks 90 are made of nonferrous material, such as fiberglass, the jacks 90 may remain in position within the foundation 16 or stem wall 14 after the foundation 14 is repaired, such as when new concrete is poured to fill the opening 60, replace removed material, and to cover the rebar 40. Furthermore, the jacks 90 are not subject to rust, nor do they provide a path for rust to the rebar or strap anchors 34*b*, and as such improve the longevity and durability of the repaired stem wall 14.

FIG. 4B also depicts an additional improvement for repairs that mitigate the need for extensive demolition and renovation of the walls in order to address the problem of corroded, rusted, weakened, or compromised anchors 34, such as strap anchors 34*b*, and rebar 40. FIG. 4B shows hold-down 70 may be used in place of a conventional anchor 34, such as metal strap anchor 34*b*, or anchor bolts 34*b*. The hold-down 70 is shown coupled to, or positioned at least partially within, the wall 18 by drilling a hole or forming an opening into the wall 18, such as within stud 32, baseplate 30, or both. The upper portion 72 of the hold-down 70 is then inserted up into the opening in the stud 32. The lower portion 74 of the hold-down 70 extends down into the space or opening 60 resulting from removed portion of the stem wall. Thus the new hold-down may be inserted into the wall 18 from within the stem wall 14 without damaging and needing to patch or repair the inner wall 17 or the outer wall 19.

Figure 4C:
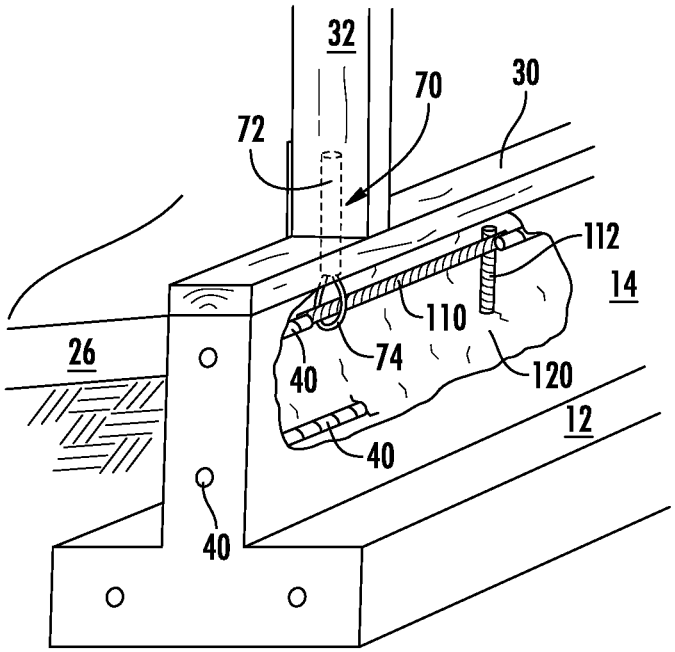

FIG. 4C shows an instance in which the hold-down 70 includes the lower portion 74 formed as loop, ring, or rope, such as a polypropylene loop, or a loop formed of any other suitable material. The lower portion 74 can be coupled to the upper portion 72 with the rigid ring 76, as shown and described, e.g., in FIG. 3A. The lower portion 74 can be coupled to the upper portion 72 of the hold-down 70 as the upper portion 72 is being disposed, drilled, or inserted into the wall 18, and more specifically disposed within the base plate 30 and the studs 32. The hold-down 70 of FIG. 4C, like the hold-down 70 of FIG. 4B, may be coupled to, or positioned at least partially within the wall 18 by drilling a hole or forming an opening into the wall 18, such as within stud 32, baseplate 30, or both. The lower portion 74 of the hold-down 70 may extend down into the space or opening 60 resulting from removed portion of the stem wall, and then inserting the hold-down up into the opening in the stud.

The hold-down 70 can be held in place mechanically, such as by friction between the wall 18 (including stud 32 and base plate 30) and the upper end 72 of the hold-down 70. The hold-downs 70 may be coupled to the walls 18, or portions thereof, both mechanically and chemically, such as with an adhesive, epoxy, or other suitable chemical bonding, with or without particular mechanical or structural features as part of the hold-down 70. In some instances, the shape, surface, or sides 78 of the hold-down 70 will include waves, ridges, undulations, or portions of larger/smaller diameter/cross sections (as shown in FIG. 3B), to desirably increase or modify the friction fit of the hold-down 70 and an amount of force supported by the connection (or required to remove it). In some instances, hold-downs 70 will support upwards of 2.67 kN (or 600 pounds) of force in a pull test, or any amount required for a strap serving a similar function to support. The force supported can also include a desired factor of safety. The hold-down 70 can also be a composite interlock hold-down strap.

FIG. 4C shows after the removal of the deteriorated portion 42 of rebar 40 is removed to form removed portion 44, a horizontal composite bar 110 formed of a non-ferrous high tensile strength material may be coupled to the exposed ends 46 of remaining rebar 40 and coupled to one or more hold-downs 70. While the horizontal composite bar 110 may be disposed within the stem wall 14 before or after placement of the hold-downs 70, in some instances the horizontal composite bar 110 will be disposed within opening 60 after placement of the hold-downs 70, so as to not crowd the work area for installation of the hold-downs 70. When coupling horizontal replacement bar 110 to one or more hold-downs 70 that include lower portion 74 formed as loops of rope or other flexible material, the horizontal bar 110 can be inserted, fed, or slipped through the loops 75 or lower portion 74 of the hold-down 70. In other instances, the lower portion 74 of the hold-downs 70 can be wired, mechanically fastened, clipped into, friction fit on, looped around, or otherwise coupled to one or more horizontal replacement bars 110, with or without an adapter, receiver, clip, or other fitting.

As such, the repaired stem wall 14 uses the horizontal composite bar 110 for reinforcing the concrete as a replacement for ferrous rebar 40. Additionally, because hold-downs 70 are made of nonferrous material, such as fiberglass, the hold-downs 70 may contact rebar 40, within the foundation or stem wall (whether rebar 40 is ferrous or not) without introducing a pathway or risk for rust or future deterioration to spread to rebar 40 after the foundation is repaired, such as when new concrete is poured to fill the opening 60, replace removed material, and to cover the rebar 40. Furthermore, the need to open a wall 18 and then repair the wall 18 is eliminated, by working below the wall 18 and in the stem wall 14. With an ability to do all work from within the stem wall 14 and below the wall 18, and to do the work from the outside of the structure 10, significant savings in demolition and reconstruction can be avoided. Thus, a system using one or more hold-downs 70, jacks 90, horizontal composite bars 11, or any combination thereof, can provide significant advantages to conventional repairs and systems and methods for carrying out the same.

FIG. 4C also shows the horizontal composite material 110 coupled to dowels 112, such as short vertically or substantially vertical section of rebar 40 or composite material 110 by drilling and dowelling the dowels 112 into the stem wall. A spacing of the dowels 112 can be at a spacing or pitch of about 1.5 meter (m) (5 foot) intervals, the dowels 112 being coupled to the horizontal composite bar 110. The dowels 112 can provide additional reinforcement, and also maintain the position of the horizontal composite bar 110 in a desired position within the stem wall 14 as the opening 60 in the stem wall 14 is patched or filled with cementitious material.

Figure 4D:
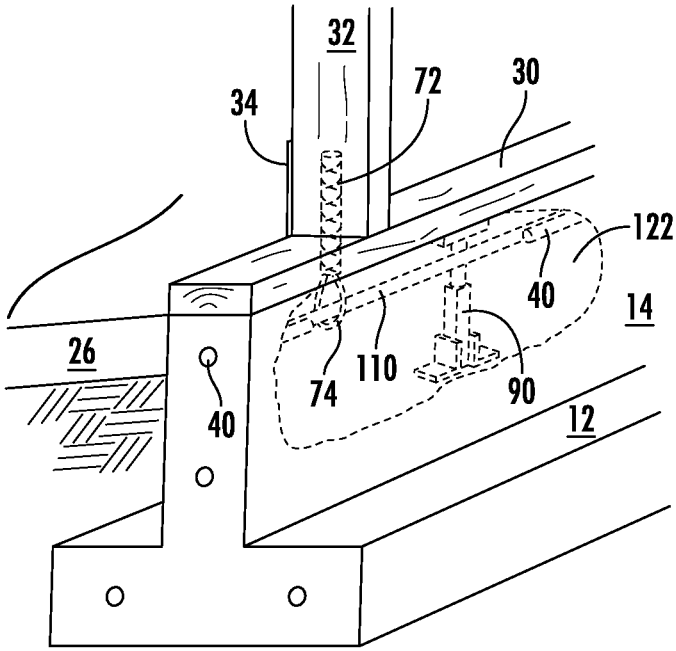

FIG. 4D shows the opening 60 in the stem wall 14 can be filled or eliminated with a parge and patch process. A surface of the opening or cavity 60 may be cleaned and parged with a parge coat and acrylic admixture or other suitable materials. The opening 60 may then be filled or patched with high strength low shrink grout mix, or other suitable cementitious material. The earth 24 adjacent the exterior of the stem wall 14 and near the repaired and patched opening 60 may be backfilled and smoothed to define new or desired exposed portion 15 of stem wall 14. When backfilling with earth 24 or other soil or material, use of compacted soil helps shed water way from structure 10, which reduces future water-related deterioration. Often code requires draining water at least 3 meters (m) (or 10 feet (ft.)) away from the structure 10. Furthermore, the exposed strip 15 may include a height of at least 15.2 cm (or 6 in.), which will comply with many code requirements and reduces a risk of flooding in the structure 10, as well as reduce a risk of termite infestation.

In accordance with the foregoing, the newly developed composite system described herein (including hold-downs 70, horizontal composite bar 110, and jack 90 as needed) may be used in repairing damage to reinforced concrete stem walls 14. Furthermore, repairs with the current system and method allow for the replacement of anchors 34, including strap anchors 34*b*, that can be done from inside the stem wall 14 and below the wall 18 to increase ease, reduces cost, and reduce repair time, with respect to conventional approaches. As such, the improved system and method of reinforced concrete stem walls 14 provides an improved structural solution to deteriorating stem walls 14.

With this system and method described herein, structural repairs are also of improved quality, lasting longer, and preventing future recurrences or relapses. Repairs may return the structure to its original design strength, which has been uncommon in past repairs. In past repairs, many contractors have ignored the problem with defective or rusted through anchors 34, including strap anchors 34*b*, and have performed cosmetic repairs that have not returned the structural strength. Additionally, the repairs may be performed without requiring removal and replacement of either the stucco or drywall from wall 18, including interior wall 17 and exterior wall 19, such that the inside the structure 10 need not undergo repairs with drywall, texture matching and paint matching. Likewise, exterior repairs requiring texture matching and paint matching to the exterior wall 19 are also avoided, repairs to the stem wall 14 being easier to accomplish.

Where the above examples, embodiments, and implementations reference examples, it should be understood by those of ordinary skill in the art that other systems, devices, and examples could be intermixed or substituted with those provided. In places where the description above refers to particular embodiments of soil moisture, stabilization, and constructions methods, it should be readily apparent that a number of modifications may be made without departing from the spirit thereof and that these embodiments and implementations may be applied to other technologies as well. Accordingly, although particular component examples may be disclosed, such components may be included of any shape, size, style, type, model, version, class, grade, measurement, concentration, material, weight, quantity, and/or the like consistent with the intended purpose, method and/or system of implementation. Thus, the presently disclosed aspects and embodiments are, therefore, to be considered in all respects as illustrative and not restrictive. The disclosed subject matter is intended to embrace all such alterations, modifications, and variations that fall within the spirit and scope of the disclosure and the knowledge of one of ordinary skill in the art, as set forth in the claims.

What is claimed is:

1. A method of reinforcing a structure including a wall built on a reinforced concrete stem wall, comprising:

removing concrete from the reinforced concrete stem wall at an exterior of the structure to expose the reinforcing material within the stem wall and create a space within the stem wall;

removing a degraded portion of the of the reinforcing material;

providing a non-ferrous jack comprising a base, a height adjustment member, and an upper pad opposite the base;

inserting a jack into the space within the stem wall, the jack base resting within the stem wall and the upper pad supporting the wall;

inserting, from below the wall, a hold-down partially disposed within the wall such that an upper portion of the hold-down is disposed within the wall and a lower portion of the hold-down extends into the space within the stem wall;

coupling a horizontal composite bar to the exposed reinforcing material and to the lower portion of the hold-down; and disposing cementitious material in the space within the stem wall, around the jack, around the lower portion of the hold-down, and around the horizontal composite bar to form a repaired stem wall.

2. The method of claim 1, further comprising adjusting the height of the jack to elevate the upper pad to a height at which the upper pad contacts a base plate of the wall.

3. The method of claim 1, wherein:

the wall comprises a base plate and a stud coupled to the base plate; and the upper portion of the hold-down is disposed partially within the base plate and partially within the stud.

4. The method of claim 1, wherein the hold-down is inserted into the wall to resist a 2.67 kN pull test.

5. The method of claim 1, further comprising filling the space within the stem wall with cementitious material with the jack within the space in the stem wall so that the jack is enveloped with the cementitious material and is incorporated within the repaired stem wall.

6. The method of claim 1, wherein the hold-down further comprises a polypropylene loop configured to support a composite reinforcement bar.

7. The method of claim 1, further comprising coupling the horizontal composite material by drilling and dowelling into the stem wall at 1.5 meter intervals and coupling the horizontal composite bar to the dowels.

8. A method of reinforcing a structure comprising a wall built on a reinforced concrete stem wall, comprising:

removing concrete from the reinforced concrete stem wall at an exterior of the structure to expose the reinforcing material within the stem wall and create a space within the stem wall;

removing a degraded portion of the reinforcing material;

inserting a hold-down partially into the wall with an upper portion of the hold-down disposed within the wall and a lower portion of the hold-down extending into the space within the stem wall;

coupling a horizontal composite bar to the exposed reinforcing material and to the lower portion of the hold-down; and disposing cementitious material in the space within the stem wall, around the lower portion of the hold-down, and around the horizontal composite bar to form a repaired stem wall.

9. The method of claim 8, further comprising:

providing a non-ferrous jack comprising a base, a height adjustment member, and an upper pad opposite the base;

inserting a jack into the space within the stem wall, the jack base resting within the stem wall and the upper pad supporting the wall;

adjusting the height of the jack to elevate the upper pad to a height at which the upper pad contacts a base plate of the wall; and filling the space within the stem wall with cementitious material with the jack within the space in the stem wall so that the jack is enveloped with the cementitious material and is incorporated within the repaired stem wall.

10. The method of claim 8, wherein:

the wall comprises a base plate and a stud coupled to the base plate; and the upper portion of the hold-down is disposed partially within the base plate and partially within the stud.

11. The method of claim 8, wherein the hold-down is inserted into the wall to resist a 2.67 kN pull test.

12. The method of claim 8, wherein the hold-down further comprises a polypropylene loop configured to support a composite reinforcement bar.

13. The method of claim 8, further comprising coupling the horizontal composite material by drilling and dowelling into the stem wall at 1.5 meter intervals and coupling the horizontal composite bar to the dowels.

14. The method of claim 8, further comprising cleaning a surface of the space within the stem wall and parging the surface of the space within the stem wall with a parge coat and acrylic admixture.

15. A method of reinforcing a structure comprising a wall built on a reinforced concrete stem wall, comprising:

exposing degraded reinforcing material within the stem wall from an exterior of the structure;

inserting a hold-down partially into the wall with an upper portion of the hold-down disposed within the wall and a lower portion of the hold-down extending into a space within the stem wall;

coupling a horizontal composite bar to the lower portion of the hold-down; and disposing cementitious material around the lower portion of the hold-down and around the horizontal composite bar to form a repaired stem wall.

16. The method of claim 15, further comprising:

providing a non-ferrous jack comprising a base, a height adjustment member, and an upper pad opposite the base;

inserting a jack into a space within the stem wall and the upper pad supporting the wall;

adjusting the height of the jack to elevate the upper pad to a height at which the upper pad contacts a base plate of the wall; and filling the space within the stem wall with cementitious material with the jack within the space within the stem wall so that the jack is enveloped with the cementitious material and is incorporated within the repaired stem wall.

17. The method of claim 15, wherein:

the wall comprises a base plate and a stud coupled to the base plate; and the upper portion of the hold-down is disposed partially within the base plate and partially within the stud.

18. The method of claim 15, wherein the hold-down further comprises a polypropylene loop configured to support a composite reinforcement bar.

19. The method of claim 15, further comprising coupling the horizontal composite material by drilling and dowelling into the stem wall at 1.5 meter intervals and coupling the horizontal composite bar to the dowels.

20. The method of claim 15, further comprising cleaning a surface of the space within the stem wall and parging the surface of the space within the stem wall with a parge coat and acrylic admixture.

* * * * *